US012018497B2

(12) United States Patent
Hatzinikolas

(10) Patent No.: US 12,018,497 B2
(45) Date of Patent: Jun. 25, 2024

(54) WALL CLADDING SUPPORT FITTINGS

(71) Applicant: Fero Corporation, Edmonton (CA)

(72) Inventor: Michael Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 8 days.

(21) Appl. No.: 16/439,663

(22) Filed: Jun. 12, 2019

(65) Prior Publication Data

US 2020/0392744 A1 Dec. 17, 2020

(51) Int. Cl.
*E04F 21/18* (2006.01)
*E04F 13/08* (2006.01)

(52) U.S. Cl.
CPC ..... *E04F 21/18* (2013.01); *E04F 13/0832* (2013.01)

(58) Field of Classification Search
CPC ... E04F 21/18; E04F 13/0832; E04F 13/0805; E04F 13/0825; E04F 13/0826; E04F 13/083; E04F 13/142; E04F 13/0803; E04B 1/7046; E04B 1/64; E04B 1/6803
See application file for complete search history.

(56) References Cited

U.S. PATENT DOCUMENTS 6,098,364 A * 8/2000 Liu ..... E04F 13/0855 52/235
8,572,917 B2 * 11/2013 Gartz ..... E04F 15/185 52/169.14
8,839,587 B2 * 9/2014 Hohmann, Jr. ..... E04B 1/4178 52/509
9,540,806 B2 * 1/2017 Lasselsberger ..... E04B 1/7645
9,783,993 B2 * 10/2017 Gleeson ..... E04B 1/40
10,100,530 B1 * 10/2018 Clark ..... E04F 13/0862
2007/0137128 A1 * 6/2007 Viau ..... B44C 5/0461 52/388
2008/0296451 A1 * 12/2008 Yoshida ..... E04F 13/0808 248/220.1
2010/0192495 A1 * 8/2010 Huff ..... E04F 13/0846 52/302.1
2012/0324814 A1 * 12/2012 Amend ..... E04B 1/7645 52/302.1
2013/0125487 A1 * 5/2013 Power ..... E04B 2/707 52/302.3
2017/0335564 A1 * 11/2017 Loyd ..... E04F 13/0826
2017/0356181 A1 * 12/2017 Krause ..... E04B 1/40

FOREIGN PATENT DOCUMENTS

CA 2987624 A1 6/2018

OTHER PUBLICATIONS

Examiner's Report CA 3,046,241 dated Dec. 27, 2023.

* cited by examiner

*Primary Examiner* — Theodore V Adamos
(74) *Attorney, Agent, or Firm* — Smart & Biggar LP

(57) ABSTRACT

A masonry veneer wall cladding system may include a first layer of a ceramic based veneer, such as formed steel calcium silicate, and a second layer that is formed of a rigid thermal insulation panel such as an expanded foam. The two layers are bonded together with an air gap between the layers. The panels are mounted to supporting wall structure with wall support mounting fittings, or cleats. The fittings have a first leg and a second leg, and a web connecting the two legs. The first leg has slots for mechanical fasteners. The slots permit the fitting to slide, so a panel can be put in place, and then the fitting, or cleat can slide down to trap the panel in place. The panel has accommodations for the engaging fingers of the cleat. In one embodiment, the air gap can define the accommodation.

5 Claims, 14 Drawing Sheets

WALL CLADDING SUPPORT FITTINGS

FIELD OF THE INVENTION

This Application relates to fittings for supporting wall cladding.

BACKGROUND OF THE INVENTION

External masonry veneer cladding systems have become popular in recent years. At the same time, advances have been made in thermal insulation of houses and other buildings. It is known to mount external cladding at a spaced distance from insulation. Variations in temperature and humidity may result in condensate forming in the wall structure. Providing a gap or space between the insulation and the cladding permits the condensate to form and drain away. The masonry cladding may be installed separately from the insulation. However, there is a convenience in providing panels of cladding that combine the insulation and a ceramic, or ceramic based, cladding in one modular unit.

SUMMARY OF THE INVENTION

In an aspect of the invention there is a wall cladding support fitting. It has a first leg; a joining web, and a retainer. The first leg has a mounting accommodation in which to admit fastening hardware to attach the first leg to a load supporting wall structure. The joining web is connected to the first leg, and stands forwardly outwardly away therefrom when the first leg is mounted to the load supporting wall structure. The retainer is mounted to the joining web distantly from the first leg. The retainer is opposed to the first leg and is spaced therefrom by a reach.

In a feature of that aspect of the invention, the retainer includes a first, downwardly extending finger, and a first cladding engagement seat is defined between the retainer and the first leg. In another feature, the retainer includes a first finger and a second finger. The first finger extends from the joining web in a first direction. The second finger extending from the joining web in a second direction, the second direction being different from the first direction. A first cladding engagement seat being defined rearwardly of the first finger, and a second cladding engagement seat being defined rearwardly of the second finger. In another feature the cladding support fitting is made from a single piece of sheet metal, the sheet metal being bent to form the first leg, the joining web, and the retainer. In still another feature, the joining web is formed square to the first leg, and the retainer is formed square to the joining web to extend in front of the first leg; and the first leg is longer than the retainer. In an additional feature, the retainer is a first retainer, and the support fitting further comprises a second retainer, the second retainer being formed square to the joining web and the first and second retainers extending away from the joining web in opposite directions, parallel to the first leg. In still another further feature, the cladding support fitting is made from stamped and bent sheet metal. The first leg is more than twice as long as it is wide. The first leg has two parallel slots formed therein in which to install fastening hardware to hold the first leg to supporting wall structure. The slots have a greater length than width, and the slots run lengthwise along more than half the length of the first leg. The joining web is bent square across the width of the first leg. The joining web has a length that is less than twice the width. The retainer is bent parallel to the first leg. The retainer has a length that is shorter than the slots.

In another aspect of the invention there is a set of wall cladding holders. The set includes at least a first wall cladding holding fitting and a second wall cladding holding fitting. Each of the first and second wall cladding holding fittings has a first leg; a joining web, and a retainer. The first leg has a mounting accommodation in which to admit fastening hardware to attach the first leg to a load supporting wall structure. The joining web is connected to the first leg, and stands forwardly outwardly away therefrom when the first led is mounted to the load supporting wall structure. The retainer is mounted to the joining web distantly from the first leg. The retainer is opposed to the first leg and being spaced therefrom by a reach. The first leg of the second wall cladding holding fitting is longer than the first leg of the first wall cladding fitting.

In another feature of that aspect, in each of the first and second wall cladding holding fittings the first leg is more than twice as long as it is wide. The first leg has two parallel slots formed therein in which to install fastening hardware to hold the first leg to supporting wall structure. The slots have a greater length than width. The slots run lengthwise along more than half the length of the first leg. The joining web is bent square across the width of the first leg. The joining web has a length that is less than twice the width. The retainer is bent parallel to the first leg. The retainer has a length that is shorter than the slots. In another feature, the slots of the first leg of the second wall cladding holding fitting are longer than the slots of the first leg of the first wall cladding holding fitting.

In another feature, the set includes at least a third wall cladding holding fitting, and the third wall cladding holding fitting has a first leg; a joining web, and a retainer. The first leg has a mounting accommodation in which to admit fastening hardware to attach the first leg to a load supporting wall structure. The joining web is connected to the first leg, and standing forwardly outwardly away therefrom when the first led is mounted to the load supporting wall structure. The retainer is mounted to the joining web distant from the first leg. The retainer includes a first finger extending in front of the first leg, and a second finger extending away from the joining web of the third wall cladding holding fitting in an opposite direction from the first finger. In an additional feature, the first leg of the third wall cladding holding fitting is longer than the first leg of the first wall cladding holding fitting.

In another aspect of the invention there is a set of wall cladding holders, the set including at least a first wall cladding holding fitting and a second wall cladding holding fitting, and a third wall cladding holding fitting. Each of the first, second, and third wall cladding holding fittings, respectively, has a first leg; a joining web, and a retainer. The first leg has a mounting accommodation in which to admit fastening hardware to attach the first leg to a load supporting wall structure. The joining web is connected to the first leg, and stands forwardly outwardly away therefrom when the first led is mounted to the load supporting wall structure. The retainer is mounted to the joining web distant from the first leg. The retainer is opposed to the first leg and is spaced therefrom by a reach distance. The retainer of the third wall cladding holding fitting includes a first finger extending away from the joining web thereof in front of the first leg thereof, and a second finger extending away from the joining web thereof in an opposite direction to the first finger.

In a feature of that aspect, in each of the first, second, and third wall cladding holding fittings the first leg is more than twice as long as it is wide. The first leg has two parallel slots formed therein in which to install fastening hardware to hold the first leg to supporting wall structure, the slots having a greater length than width, and the slots running lengthwise along more than half the length of the first leg. The joining web is bent square across the width of the first leg. The joining web has a length that is less than twice the width. The retainer is bent parallel to the first leg. The retainer has a length that is shorter than the slots. In the retainer, at least one of:

(a) the respective first legs of the second and third wall cladding holding fittings are longer than the first leg of the first wall cladding holding fitting; and (b) the respective slots of the second and third wall cladding holding fittings are longer than the slots of the first wall cladding holding fitting.

In another aspect of the invention there is a wall cladding assembly. It has at least a first cladding panel and a set of mounting fittings by at least that first cladding panel is secured to supporting structure. The cladding panel includes a first layer and a second layer. The first layer is an exterior facing layer and has an outermost surface. The second layer is an interior facing layer to which the first layer is mounted. The second layer has a first face that, in use, is oriented toward the supporting structure and a second face that, in use, oriented away from the supporting structure. The second face has protrusions extending outwardly therefrom to which the first layer is secured. The set of mounting fittings includes (a) at least a first mounting fitting that receives a lower edge of the first cladding panel; (b) at least a second mounting fitting that receives an upper edge of the second cladding panel; and (c) the second mounting fitting is movably mounted to the supporting structure. The second mounting fitting is movable between a first position permitting reception of the first cladding panel by the first mounting fitting, and a second position locking the first cladding panel in place.

In a feature of that aspect the second mounting fitting has a first leg; a joining web, and a retainer. The first leg has a mounting accommodation in which to admit fastening hardware to attach the first leg to a load supporting wall structure. The joining web is connected to the first leg, and stands forwardly outwardly away therefrom when the first leg is mounted to the load supporting wall structure. The retainer is mounted to the joining web distantly from the first leg. The retainer being opposed to the first leg and is spaced therefrom by a reach. When the second mounting fitting is in the second position thereof, the retainer engages the first cladding panel between the outermost surface of the first layer and the first face of the second layer. In another feature, when the second mounting fitting is in the second position, the retainer is introduced between the first layer and the second layer of the first panel. In a further feature, the first layer of the first panel has accommodations formed therein for end portions of the protrusions of the second layer of the first cladding panel, the end portions being engaged therein. There are spaces between the protrusions. The retainer includes at least a first finger. In the second position of the retainer at least the first finger seats between in one of the spaces behind the first layer of the first panel.

In a further feature, the assembly includes a second cladding panel, the second cladding panel having first and second layers in the same manner as the first cladding panel. The second mounting fitting retainer has a first finger engaging the first cladding panel and a second finger engaging the second cladding panel. In another feature, the first layer of each of the first and second cladding panels has accommodations formed therein, and in which are engaged end portions of the protrusions of the second layer of the respective cladding panel, there being spaces between the protrusions. The first finger of the retainer seats in a space between protrusions of the second layer of the first cladding panel behind the first layer of the first cladding panel. The second finger of the retainer seats in a space between protrusions of the second layer of the second cladding panel behind the first layer of the second cladding panel.

In another aspect of the invention there is a wall cladding assembly. It has at least a first wall veneer panel. It may have an array of rows and columns of such panels. The wall veneer panel has a first layer and a second layer. The first layer is a masonry veneer layer having a first surface, a second surface and a through-thickness. The first surface is a finished surface for external viewing. The second surface is opposed to the first surface and faces rearwardly. The second surface has a first set of seats formed in the masonry veneer layer. The second layer has a length and a width corresponding to the first layer. The second layer including a rigid thermal insulation material. The second layer has a first surface and a second surface. The first surface of the second layer faces toward the first layer. The second surface of the second layer faces away from the first layer. The second layer has a through thickness between the first and second surface thereof. The second layer has a second set of seats. The second set of seats of the second layer is mechanically engaged to the first set of seats of the first layer. The first and second sets of seats, when engaged, establish a standoff air gap between the first layer and the second layer. The second layer has mounting fitting accommodations.

In a feature of that aspect, the mounting fitting accommodations are defined at least in part by the air gap. In a different feature the thermal insulation of the second layer has slots formed therein to define the mounting fitting accommodations, the slots being separate spaced away from the gap. In another feature, the masonry veneer layer is made of a steel calcium silicate board, and the thermal insulation layer is made of expanded polyurethane or expanded polystyrene. In still another feature, the wall mounting fittings include J-shaped fittings having a first leg, a second leg, and a web extending between the first and second legs; the first leg being longer than the second leg; the first leg having slots in which to admit mechanical fasteners; and at least one of the mounting fittings being secured to stationary support structure and having a slidable range of motion relative to the support structure.

In another aspect of the invention, there is any apparatus substantially as shown or described herein, in whole or in part.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION

Figure 1A:
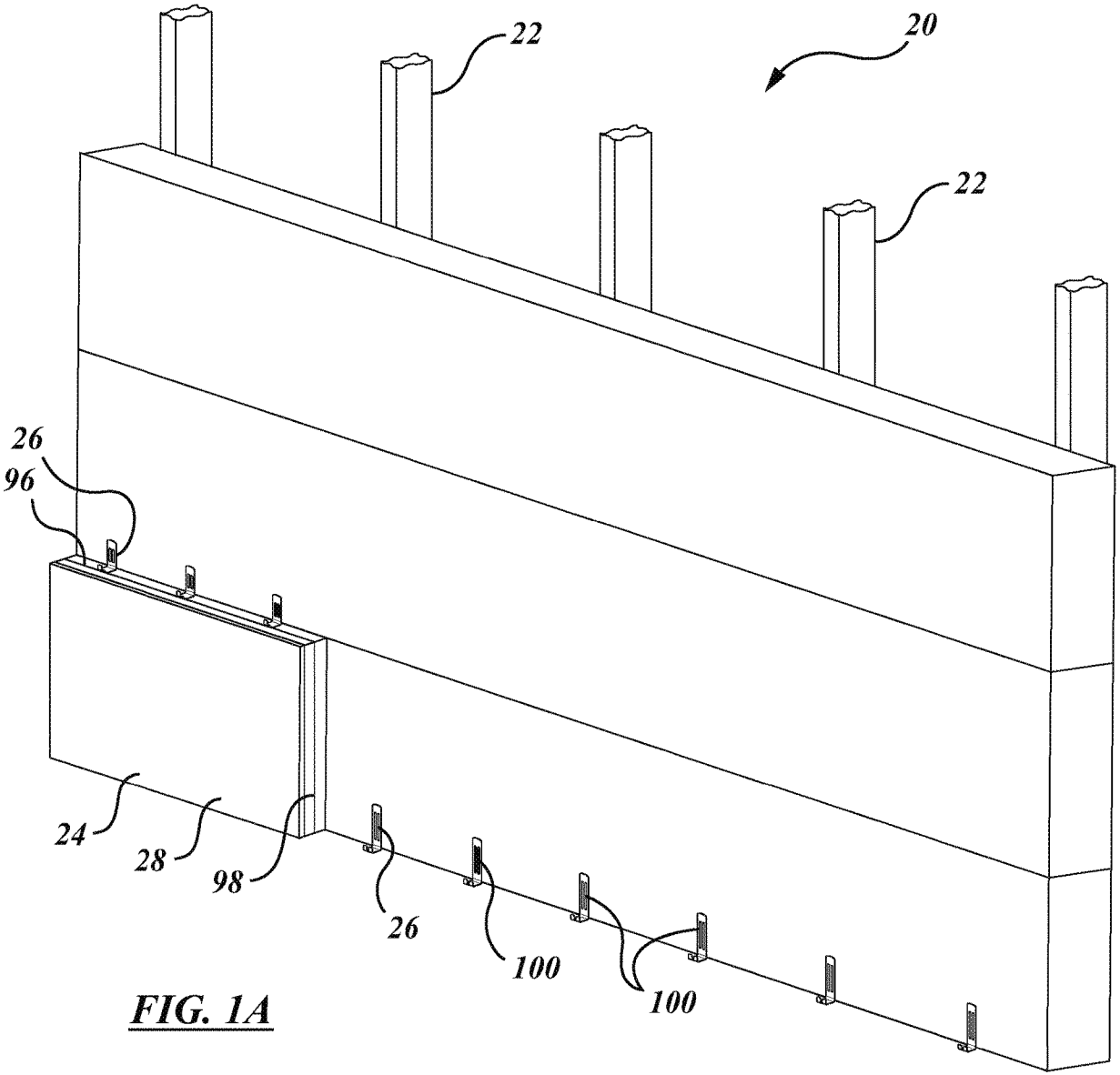
FIG. 1*a* shows a perspective general arrangement view of a wall structure with an external screen panel with a first external veneer panel in place.
Figure 1B:
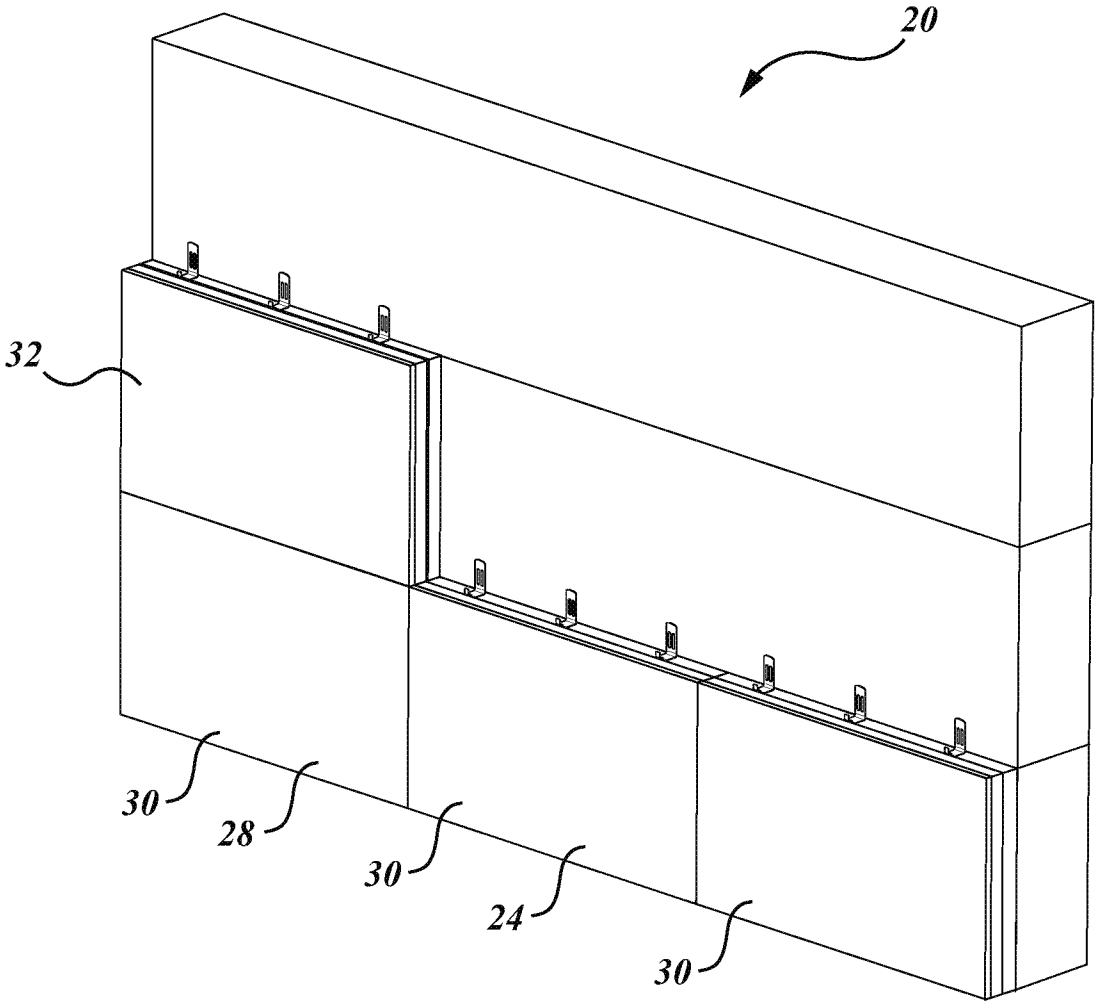
FIG. 1*b* shows the wall structure of FIG. 1*a* with a larger number of external veneer panels in place.
Figure 1C:
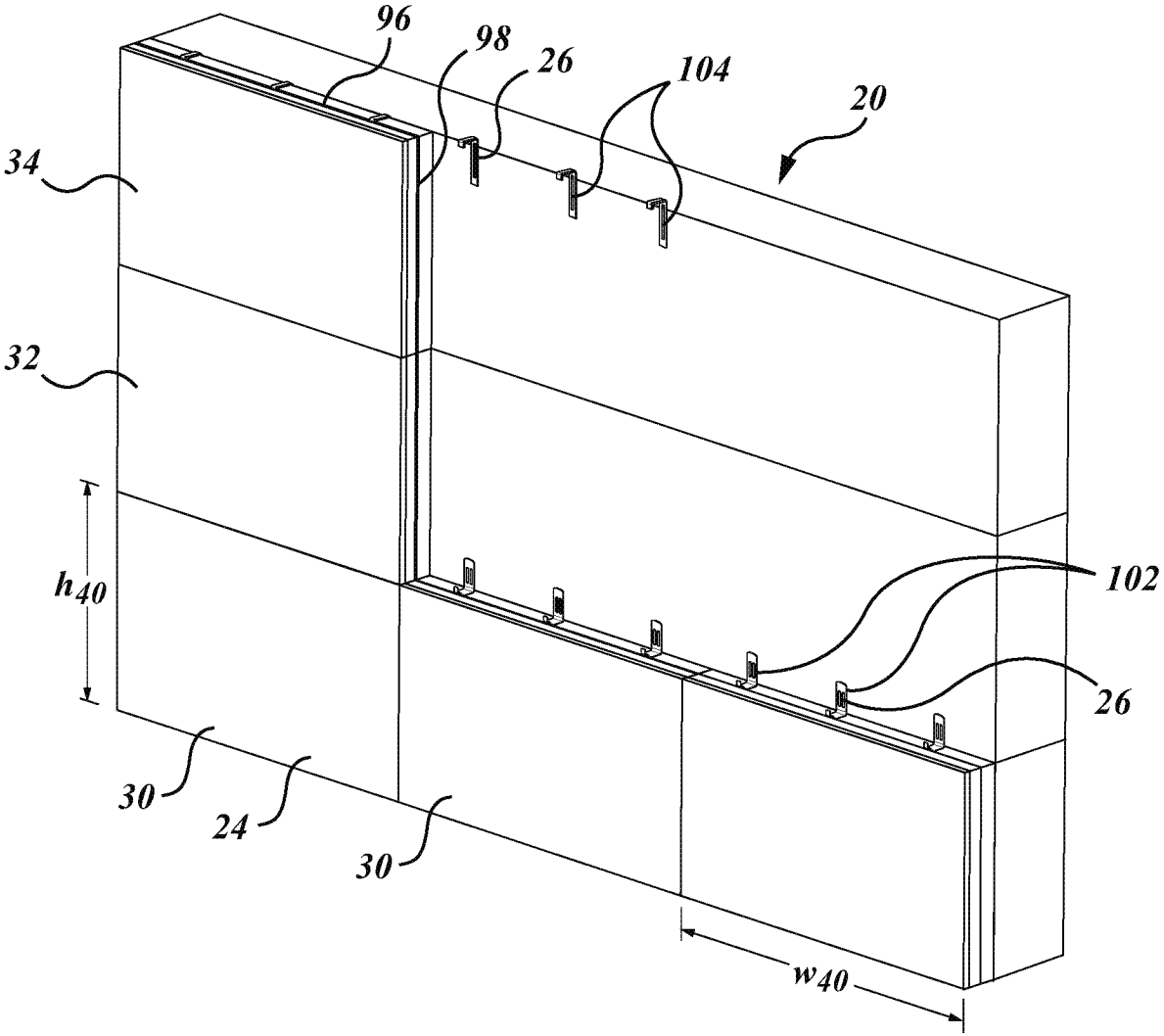
FIG. 1*c* shows the wall structure of FIG. 1*a* with a full row and a full column of external veneer panels in place.
Figure 2A:
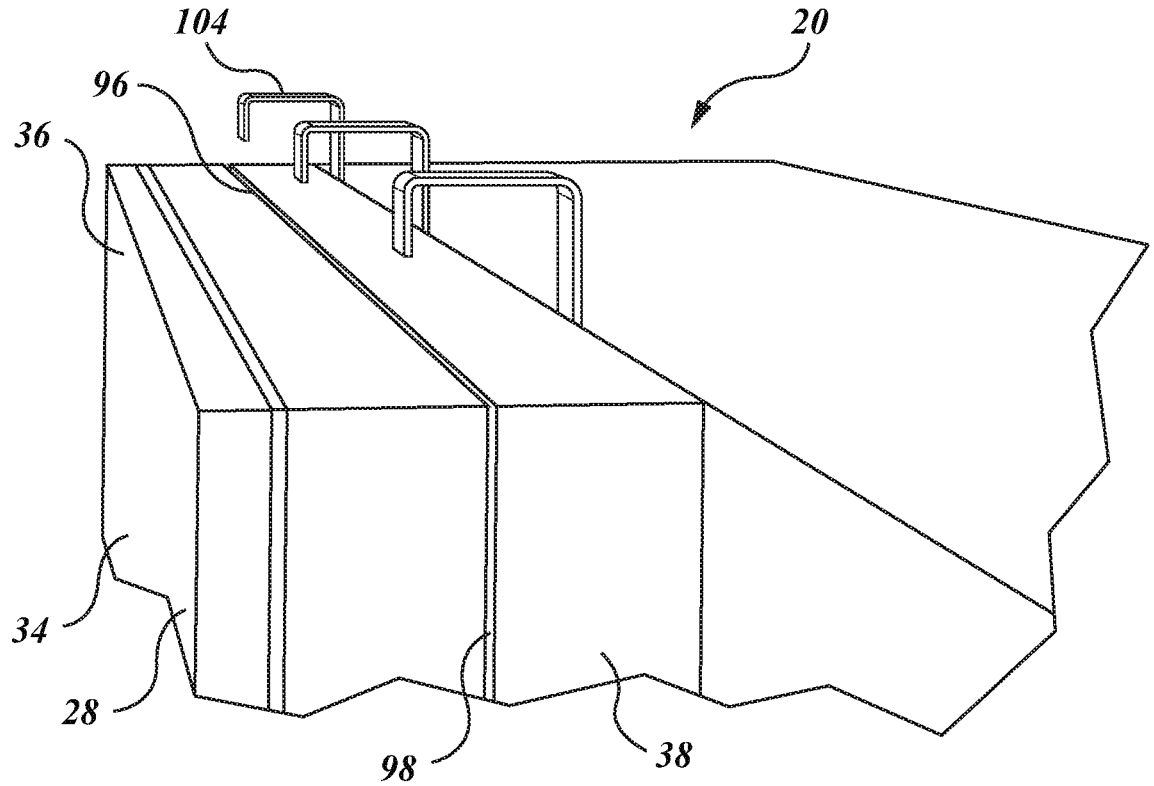
FIG. 2*a* shows an enlarged detail perspective view of the top margin of the top panel of the wall structure of FIG. 1*c* as placed.
Figure 2B:
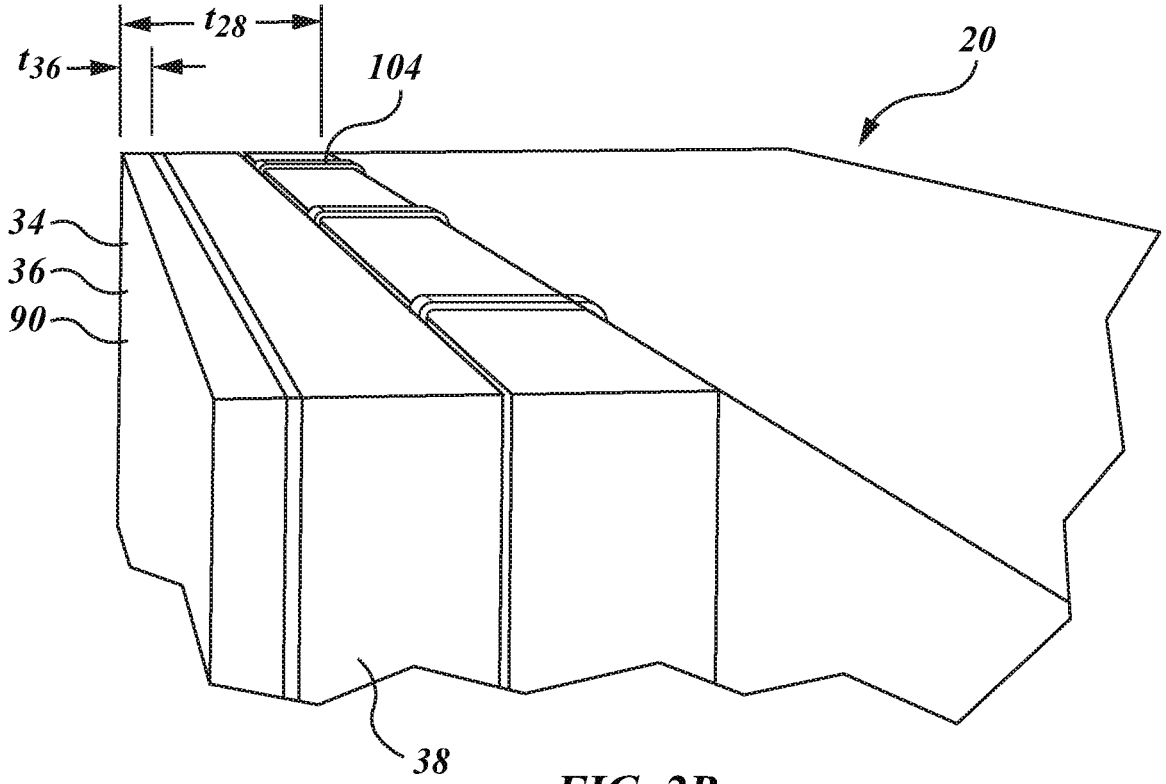
FIG. 2*b* shows the enlarged detail of FIG. 2*a* with retaining clips secured.

The description that follows, and the embodiments described therein, are provided by way of illustration of an example, or examples, of particular embodiments of various aspects and features of the invention. These examples are provided for the purposes of explanation, and not of limitation, of those principles and of the invention. In the description, like parts are marked throughout the specification and the drawings with the same respective reference numerals. The drawings may be understood to be to scale and in proportion unless otherwise noted. The wording used herein is intended to include both singular and plural where such would be understood, and to include synonyms or analogous terminology to the terminology used, and to include equivalents thereof in English or in any language into which this specification many be translated, without being limited to specific words or phrases.

For the purposes of this description, a Cartesian frame of reference may be employed. In such a frame of reference, the long, or largest, dimension of an object may be considered to extend in the direction of the x-axis, being the longitudinal axis. The height of the object is measured in the vertical, or z-direction; and the distance in the rear-to-front direction is measured in the y-direction. Unless noted otherwise, the terms "inside" and "outside", "inwardly" and "outwardly", refer to location or orientation inside the frame or housing of the apparatus.

In this specification, the commonly used engineering terms "proud", "flush" and "shy" may be used to denote items that, respectively, protrude beyond an adjacent element, are level with an adjacent element, or do not extend as far as an adjacent element, the terms corresponding conceptually to the conditions of "greater than", "equal to" and "less than". Unless otherwise noted, the assembly shown and described herein may tend to be symmetrical, or largely symmetrical, about the central vertical forward and rearward plane.

In a general overview, there is a frame or wall, indicated generally as a load bearing structure 20. This structure may be a wooden framed structure, a steel structure or steel posts and beams, welded or otherwise assembled; it may be a masonry structure or concrete, block, or bricks; or it may be some combination of wood, steel, or masonry. In some embodiments it may include an array of vertical studs or posts 22 to which an external cladding assembly 24 is mounted. Cladding assembly 24 may include an array of panels 28 connected to the supporting structure 20 by a set of mounting fittings 26.

Array of panels 28 may include many panels such as might be used to cover a wall. The panels may be arranged in rows and columns, and may be staggered such that alternating seams do not align e.g., in the manner of overlapping bricks in a wall, and may in some circumstances be installed in non-horizontal rows, such as on a diagonal angle, and so on. For the purposes of illustration, panels 28 are shown in horizontal rows or courses (i.e., extending in the y-direction) and vertical columns (i.e., in the z-direction). The overall through-thickness of any one panel 28 is identified as t28 (i.e., in the x-direction). Also for the purposes of this discussion, one of the panels in the lowest row may be arbitrarily designated as a "first cladding panel", 30. The panel next-above first cladding panel 30 may likewise be arbitrarily designated as "second cladding panel" 32. The still further upwardly located panel may be designated as "third cladding panel" 34. There may be more than three such rows. Generically, however, cladding panel 30 is representative of the bottommost panel in the wall assembly. It only has panels above itself. Cladding panel 32 is generically representative of any intermediate panel that has panels both above and below. Cladding panel 34 is representative of a topmost panel that only has other panels below itself. Any of panels 30, 32 and 34 may have other panels beside itself (i.e., in the y-direction cross-wise in the wall, generally). A wall may potentially have any number of such panels as may be suitable for covering, or cladding, a given surface area.

Each cladding panel may have a first portion or first layer 36 and a second portion or second layer 38. For the purposes of this discussion, the first layer 36 will be considered the outer layer, and the second layer will be considered the inner layer, on the basis that, when installed, second layer 38 is closer to the supporting structure 20, and first layer 36 is farther away from the supporting structure 20, and the exposed surface of first layer 36 faces generally outward, away from supporting structure 20 (i.e., in the positive x-direction). First layer 36 may be made of a ceramic or ceramic composite board, and may have a textured finish, whether to be or to simulate brick, or stone, or stucco, or such other facing as may be.

Second layer 38 may be made of thermal insulation. That thermal insulation may have the form of an expanded polyurethane foam. Second layer 38 may be made substantially as shown and described in U.S. Pat. No. 9,010,050 at FIG. 3. That is, second layer 38 may have the foam of a substantially planar panel 40 having a height, $h_{40}$, (i.e., the overall dimension in the z-direction, when installed) and a width $W_{40}$, (i.e., the overall width in the y-direction, when installed). The through-thickness direction of panel 40, $t_{40}$, in the x-direction is much smaller than at least one of the height and the width, and, typically, is much smaller than either of them. For example, the overall long dimension in the y-direction may be 4 ft., 6 ft., or 8 ft. The overall vertical or z-direction, may in some cases be 16 inches, or 19.2 inches, or 2 ft., or 30 inches, or 4 ft., or 8 ft. Alternatively, the long direction may be vertical, and the sorter dimension may be horizontal. Second layer 38 may be mounted to the supporting load bearing structure as described below. Where a vapour barrier has been applied, panel 40 may be mounted outside that vapour barrier.

Panel 40 has a front face or first face 42 that, as installed, faces toward, or is oriented toward, first layer 36. Panel 40 has a second face, which may be designated a rearward face, 44, that, as installed, faces, and may be mounted against or spaced outwardly from, supporting load-bearing structure 20. Panel 40 has a top edge, 46, a bottom edge 48, a first side edge 50, and a second side edge 52. Rearward face 44 may be substantially planar, and may be flat or substantially flat. The edges, 46, 48, 50 and 52 may be planar and flat and may define the edge faces of a rectangle. Although this need not be so, it is convenient that panel 40 be rectangular. Front face 42 of panel 40 has a set, a group, or an array of stand-offs, or protrusions, or prongs, or protruding members, indicated generally as 60, however they may be called. The various protrusions 62 in the array are spaced from each other vertically and horizontally such that air may circulate both vertically and laterally in the spaces between adjacent protrusions. In some embodiments, the protrusions may have the form of cylindrical or conical posts or stubs, as in CA 2,774,897 FIG. 7, which is incorporated herein by reference. In the embodiment illustrated, protrusions 62 have the form of generally rectangular posts or abutments or blocks, indicated as 64, however they may be named. Blocks 64 may be wider (in the y-direction) than high (in the z-direction).

Figure 3A:
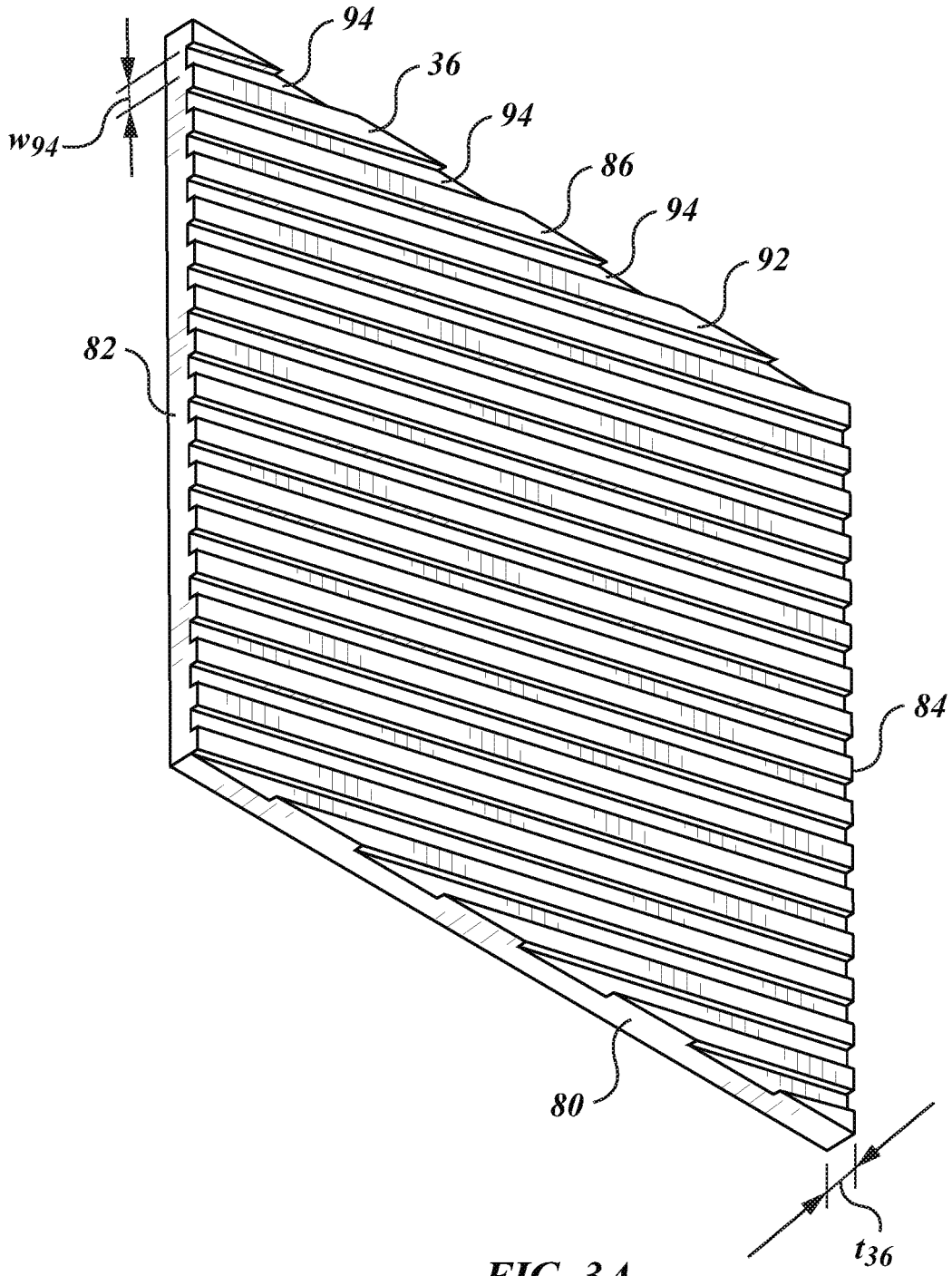
FIG. 3*a* is an isometric rearward view of a face component of one of the veneer panels of FIG. 1*a;*
Figure 3B:
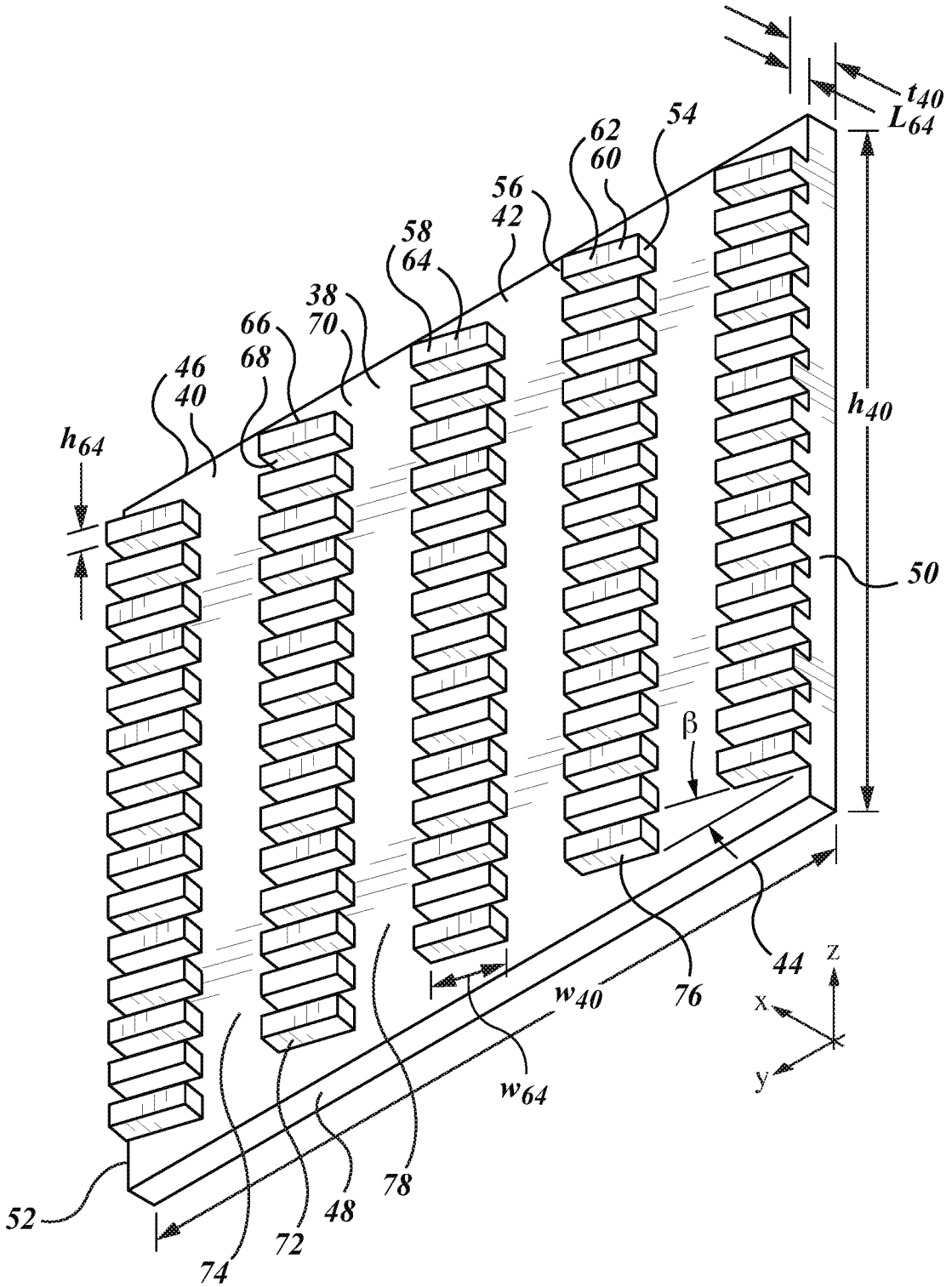
FIG. 3*b* is an isometric rearward view of a backing component that mates with the veneer panel face component of FIG. 3*a;*
Figure 3C:
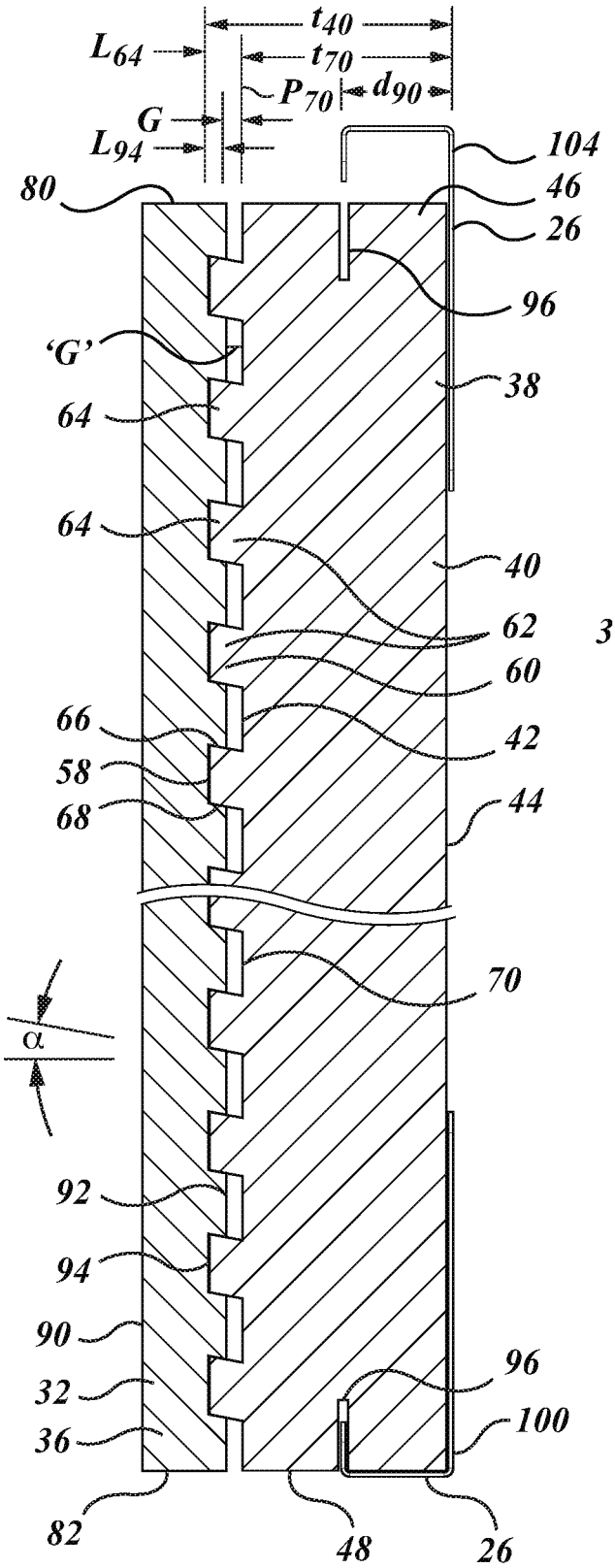
FIG. 3*c* is a vertically fore-shortened cross-section of a veneer panel as in FIG. 1*a;*

FIGS. 3*a* and 3*b* show first layer or portion 36 and the second layer or portion 38 apart and facing each other prior to being mated. The cross-sectional view of FIG. 3*c* shows layers or portions 36 and 38 mated together. In FIG. 3*c*, stand-offs 64 may be inclined upwardly forwardly at an angle alpha. Each abutment or standoff 64 may have a left-hand edge or surface 54, a right-hand edge or surface 56, a front end or surface 58, a top face or surface 66 and a bottom face or surface 68. The rearward end, or root, of block 64 merges into the body of panel 40 more generally. The top surface 66 of each abutment may have a rearward downward slope, such that any condensation may tend to be encouraged by gravity to flow away from first layer 36 toward second layer 38. Similarly, looking at FIG. 3*b*, top surface 66 may be laterally slanted as at angle beta, such that condensation may tend to drip off to one side, be it left or right according to the slant of the surface. Although the various sides are shown as parallelograms, and the width, $W_{64}$ of block 64 is shown as being larger than the height, $h_{64}$, of block 64, this need not necessarily be so. Looking at the front face, or surface 58, it could be diamond shaped, and could have sloped faces on both sides of the diamond. In the embodiment shown, side edges of faces 54, 56 lie in vertical planes. In the embodiment shown, one or the other, or both, of the width $W_{64}$ and height $h_{64}$ of protrusions 64 is substantially greater than the depth $L_{64}$ of protrusion 64 in the x-direction. That is, protrusion 64 is a short column, or very short column, where the ratio of column height (i.e., $L_{64}$) to column area cross-sectional square root is less than one, and may be less than 0.75. $L_{64}$ and $h_{64}$ may be about the same, i.e., a ratio of their lengths may be in the range of 1:2 to 2:1. Between and around the roots of protrusions 64 the front surface of panel 40 is indicated as surface 70. Surface 70 may be flat and planar. Surface 70 may be parallel to second face 44.

In this embodiment, protrusions 62 are arranged in vertical rows or strips, e.g., 72, 76, as seen in FIG. 3*b*. Successive strips are spaced apart by alternating strips or regions e.g., 74, 78, that have no such blocks but that are substantially smooth and planar, i.e., free of protrusions, and that are parts of surface 70 more generally. Although respective first and second such strips are noted, there may be many such alternating strips across the front face of panel 40. In this embodiment, width of strips 72, 76 is the same, or roughly the same, as the width of strips 74, 78, although this need not be so. Protrusion strips 72, 76 could have a width corresponding to the width of framing studs, and could be set on spaced centers laterally corresponding to the lateral spacing of studs, be it 12", 16", 19.2", 24", and so on. Similarly, strips 72, 76 of protrusions 62 need not be vertical, but could be horizontal or diagonal, or sinuous, as may be. Panel 40 can be made by profiling an insulation monolith, as with a hot wire, or it can be made by affixing strips 72, 76 to an existing constant thickness insulation board. In any case, the resulting structure leaves air gaps in the upstanding and lateral directions.

First layer or panel 36 may be made of a composite or ceramic, such as a steel calcium silicate board. Like layer or panel 38, layer or panel 36 may be generally planar. It may generally have the same height and width as panel 40, and its bottom, left hand, right hand and top edges 80, 82, 84, 86, may be aligned in x-direction projection with the corresponding edges 48, 50, 52, 46 of panel 40. Alternatively, those edges may be offset either laterally (in the y-direction) or vertically (in the z-direction), or both, by some distance, such that when adjacent panels abut there is a tongue-and-groove effect where the seams of adjacent first panels are offset from the seams of adjacent second panels. For convenience, in the embodiment shown the edges align. The over-all through-thickness, $t_{36}$, of first layer or panel 36 may be larger or smaller than the overall through thickness $t_{40}$ of planar panel 40, but is generally comparable thereto, and is typically much smaller than the height or width of panel 36.

First layer or panel 36 has a first, or frontward, face 90, and a second, or rearward face 92. Frontward face 90 defines the external face of first layer 36. It may be coloured or textured to yield a particular form such as brick, stone, or rock. The rear face 92 of first layer 36 may have accommodations, or reliefs, or seats, or rabbets, or grooves or slots, or channels 94, formed therein, however they may be termed. Grooves 94 provide accommodations, or seats, for the ends of protrusions 62. To that end, grooves 94 may be of slightly smaller width $W_{94}$ in the vertical direction than the height of protrusions 64 in the vertical direction such that the tips of protrusions 64 are pressed into grooves 94 in an interference fit. The depth, $L_{94}$, of grooves 94 is less than the length $L_{64}$ of protrusions 64, such that a gap dimension 'G' remains between the rearmost face 92 of first panel or layer 36 generally, and the frontwardly facing dominant surface plane $P_{70}$ of the root surface 70 of first panel 40. This space or gap, or standoff distance, G, preserves room for air to move about protrusions 62 between first layer 36 and second layer 38.

Second portion or layer 38 may have seats, or accommodations, or rebates, or grooves, or slots, however they may be termed, such as may be formed in the long-side upper faces or edge 46 or in the lower face or edge 48. These accommodations are indicated as 96. Similarly, since panels 30, 32 and 34 may be oriented horizontally, or vertically, or at an angle that is neither horizontal nor vertical, similar slots, or groove or accommodations 98 may be formed in in the short-side edges of faces 50 and 52. These accommodations 96 or 98 may be at a fixed depth from face 44, and may combine to form a peripheral groove or rabbet extending fully around the outside of panels 30, 32 and 34 as may be. That depth may be indicated as $d_{96}$. Accommodations 96 or 98, or both, may define the seats, or pockets, or lodgements, or niches, into which retaining hardware fits when engaged to secure panels 30, 32, or 34 to the supporting structure 20, and to retain them in an immobile condition. In the embodiment of FIG. 3*c*, the accommodations are spaced away from the air gap between panels 36 and 38.

Figure 3D:
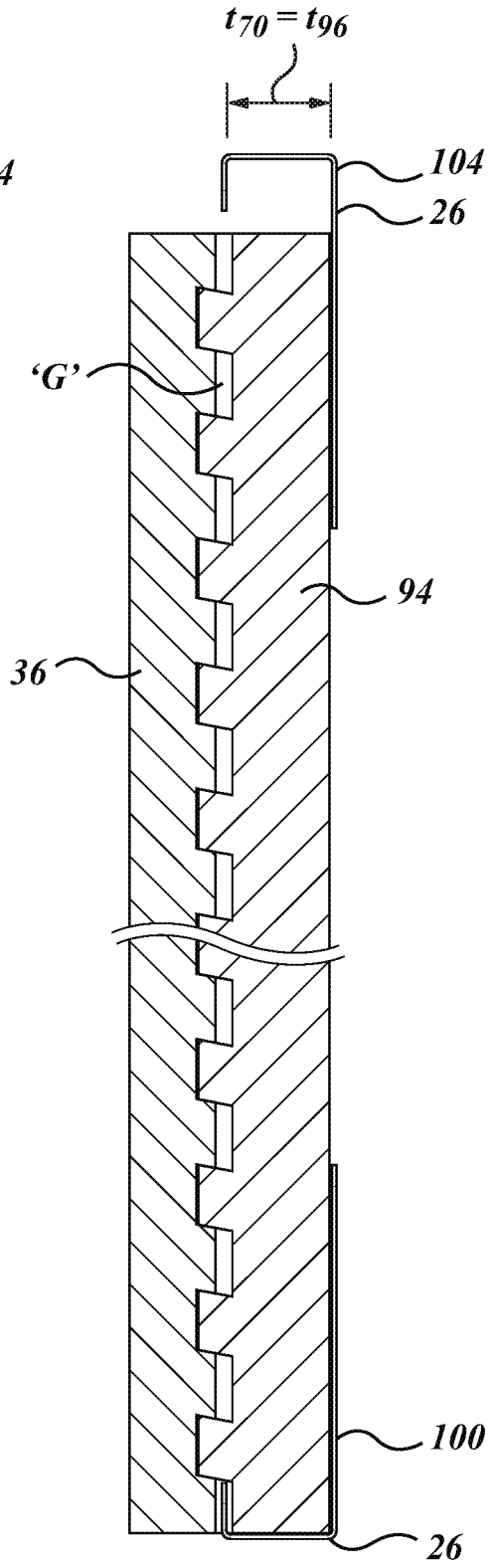
FIG. 3*d* is an alternate embodiment to that of FIG. 3*c;*
Figure 3E:
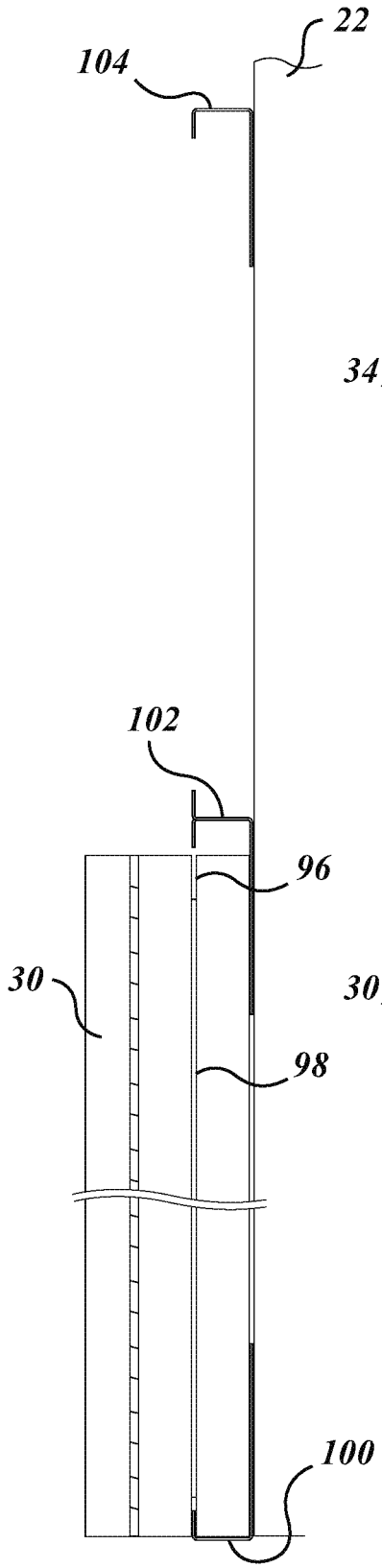
FIG. 3*e* shows a side view of a first veneer panel such as that of FIG. 3*c* in position ready for securement.
Figure 3F:
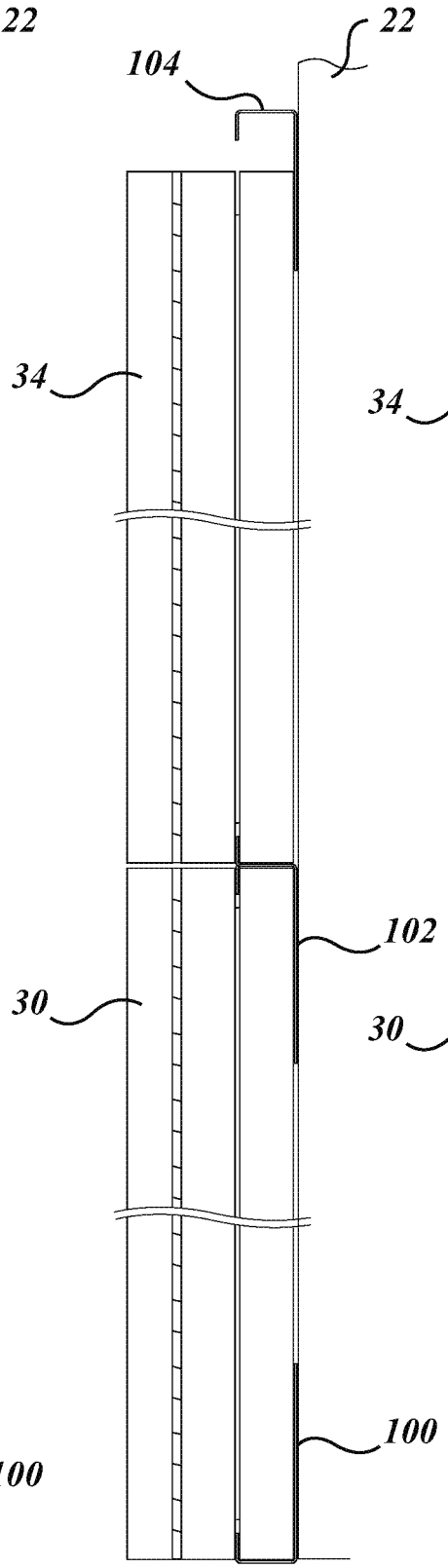
FIG. 3*f* shows the veneer panel of FIG. 3*e* secured, and a second veneer panel placed above the first veneer panel ready for securement.
Figure 3G:
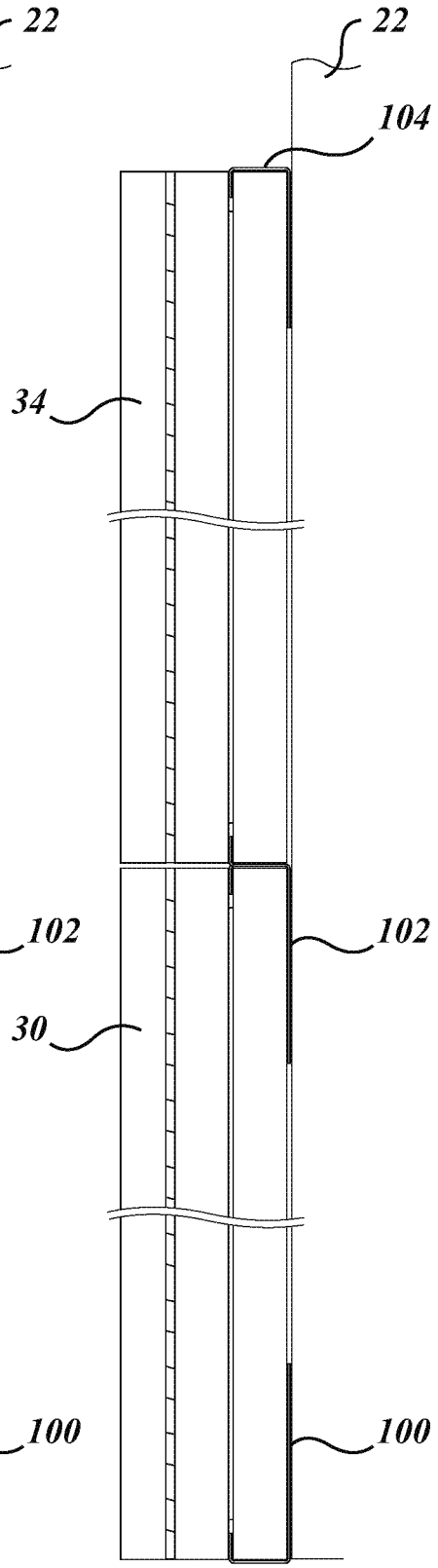
FIG. 3*g* shows the two veneer panels secured in place.

The size of depth $d_{96}$ may correspond to the size of the holding member or retainer. However, the thickness of insulation may vary with the location of the structure, and with the thermal barrier designed for that structure. In the general case, thickness $t_{40}$ (or $t_{70}$, as may be) may vary according to the R value of the insulation, whereas the size of the retaining hardware, and thus of depth $d_{96}$, may be constant. In the embodiment of FIG. 3*d*, depth $d_{96}$ and thickness $t_{70}$ of the second portion, or layer or panel 88 (otherwise corresponding to second portion or layer 38), the rearward panel or layer are the same, or substantially the same, such that accommodations 96 and 98 are defined in the space of gap 'G', such that there is not a separate additional circumferential slot formed in second portion or layer 38 of panel 28. In this circumstance, the mounting fitting accommodations, or pockets, or slots are defined at least in part by the air gap. That is, the inside or rearward face of the accommodation is defined by the forward face of panel 38, and the outside face of the accommodation is defined by the rearward face of the ceramic veneer of panel 36.

In either case, the first and second layers or portions are mated together to yield a sandwich, or laminate, that has an insulation portion and a facing portion or veneer portion. The veneer portion is a ceramic or ceramic-based material, and, as noted, may be a steel calcium silicate. The insulation portion and the veneer portion are mechanically interlinked by the setting of the ends of blocks 64 in the grooves or slots defined by 96. The standoffs defined by blocks 64 establish an air space, gap G, for condensation to form and drain.

Cladding panels 30, 32 and 34 are mounted to load bearing structure with fittings 26. Fittings 26 may include bottom edge fittings 100, intermediate edge fittings 102, and top edge fittings 104, or such combination thereof as may be appropriate. The various fittings 100, 102, and 104 may be referred to as hooks, holders, grips, cleats, or retainers, however they may be called. Where there is only a single panel, no intermediate edge fittings 102 may be required, but rather only a bottom fitting and a top fitting. Where more than one row of panels is present, a pair of bottom edge fittings 100 and top edge fittings 104 could be used in place of an intermediate edge fitting between successive rows, though less conveniently.

Figure 4A:
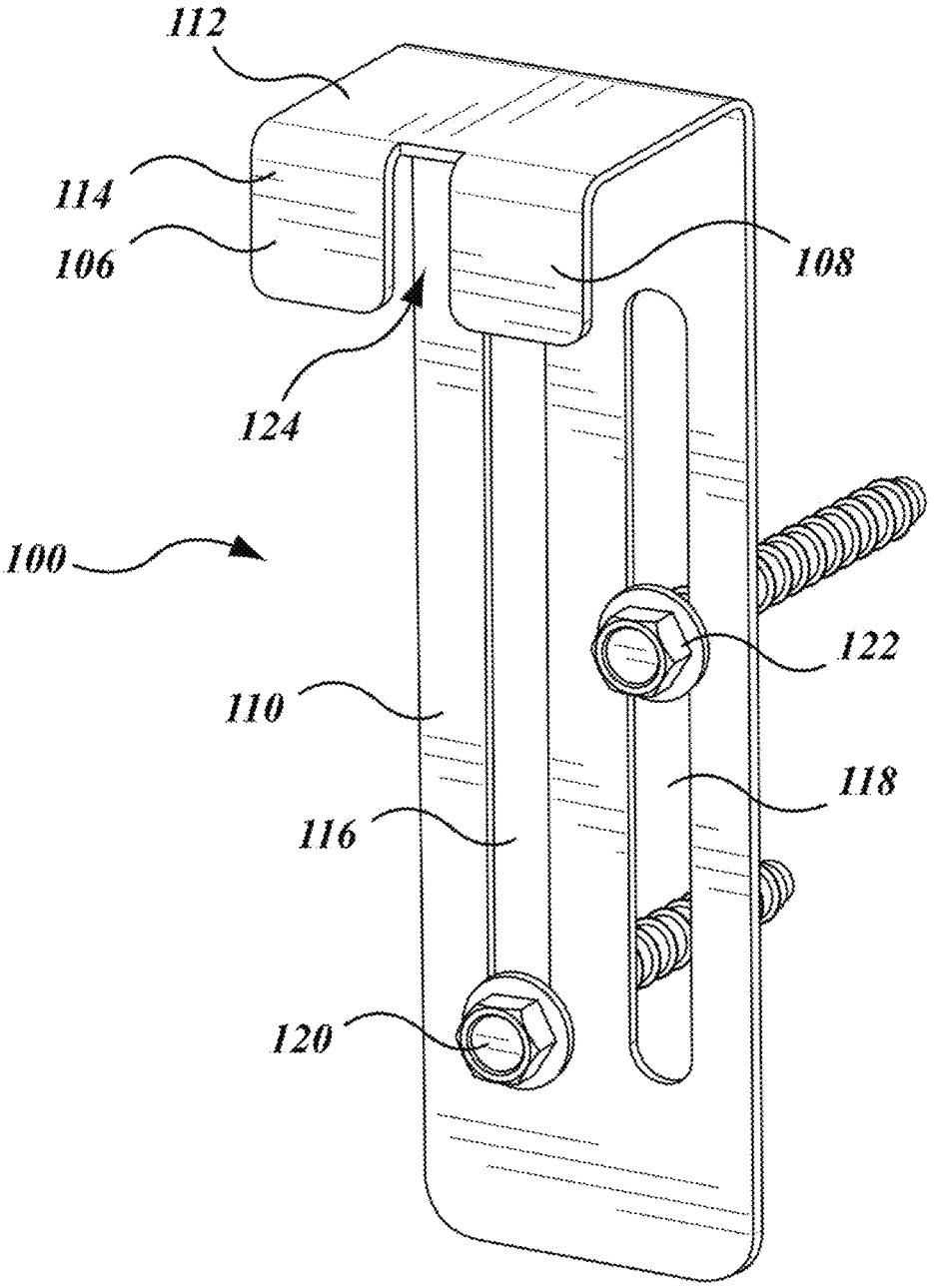
FIG. 4A (Prior Art)
FIG. 4*a* is a front isometric view of a first retainer of the assemblies of FIGS. 3*c*-3*f* with fastening hardware in position.
Figure 4B:
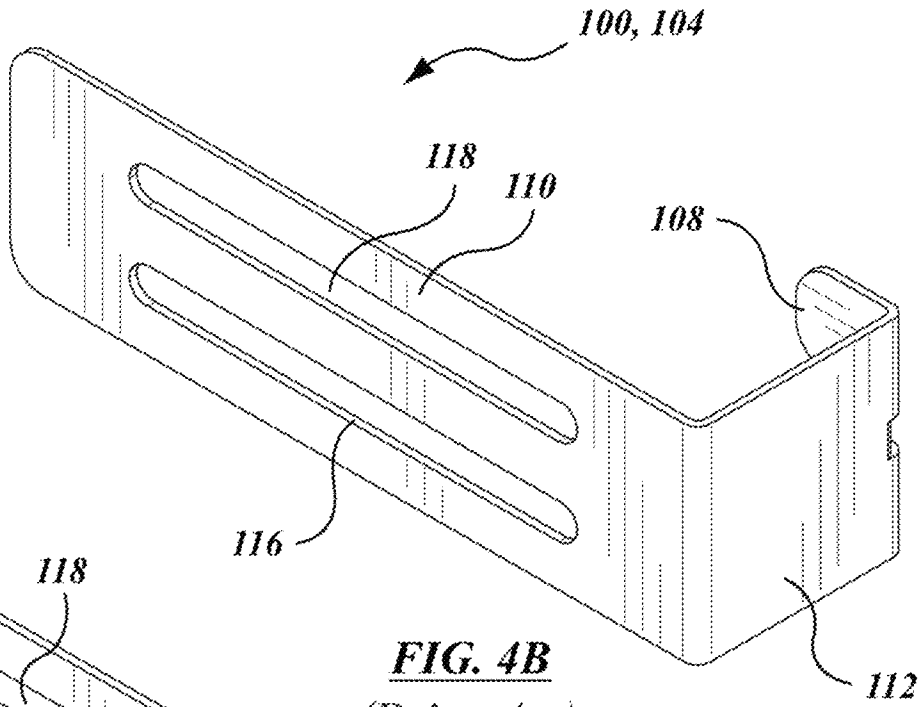
FIG. 4B (Prior Art)
FIG. 4*b* is a rear isometric view of the first retainer of FIG. 4*a;*
Figure 4C:
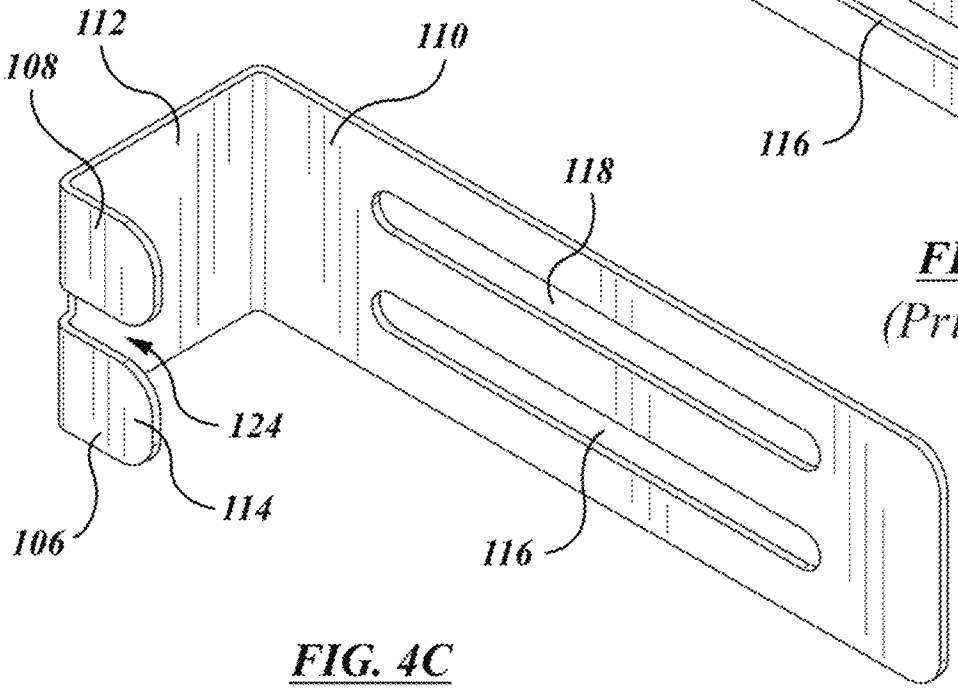
FIG. 4C (Prior Art)
FIG. 4*c* is an opposite isometric view of the first retainer of FIG. 4*b;*
Figure 4D:
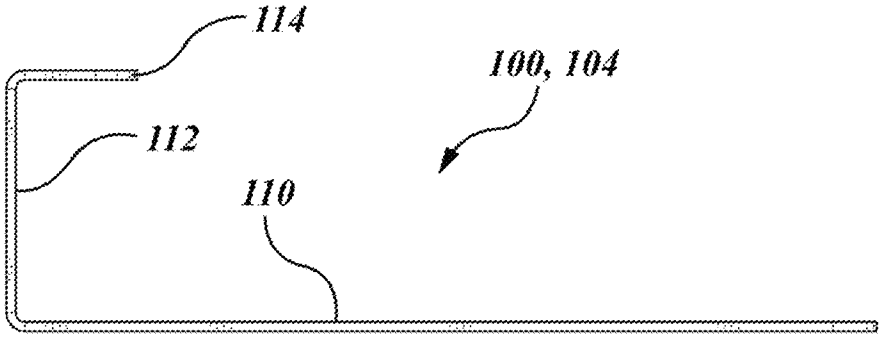
FIG. 4D (Prior Art)
FIG. 4*d* is a side view of the first retainer of FIG. 4*b;*
Figure 4E:
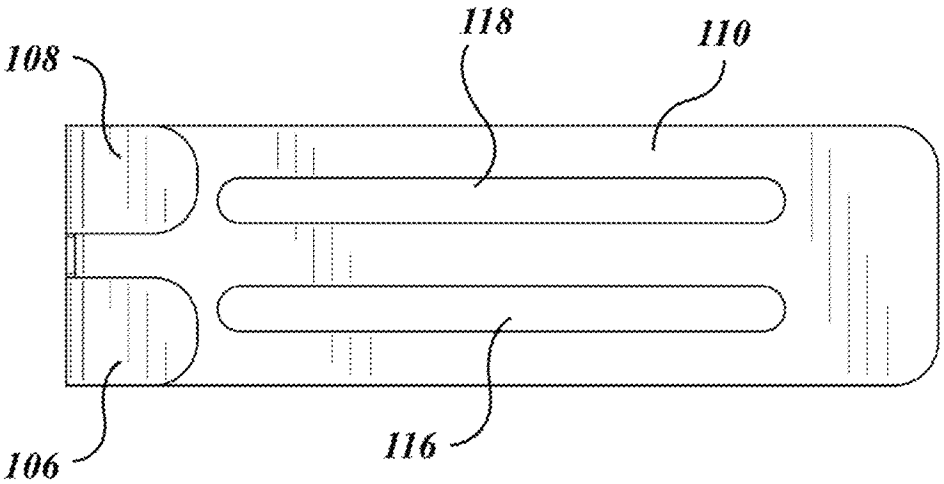
FIG. 4E (Prior Art)
FIG. 4*e* is a front view of the first retainer of FIG. 4*b;*
Figure 4F:
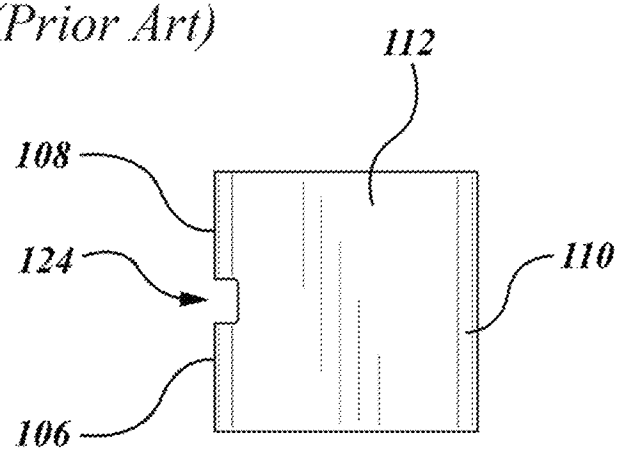
FIG. 4F (Prior Art)
FIG. 4*f* is an end view of the first retainer of FIG. 4*b;*
Figure 5A:
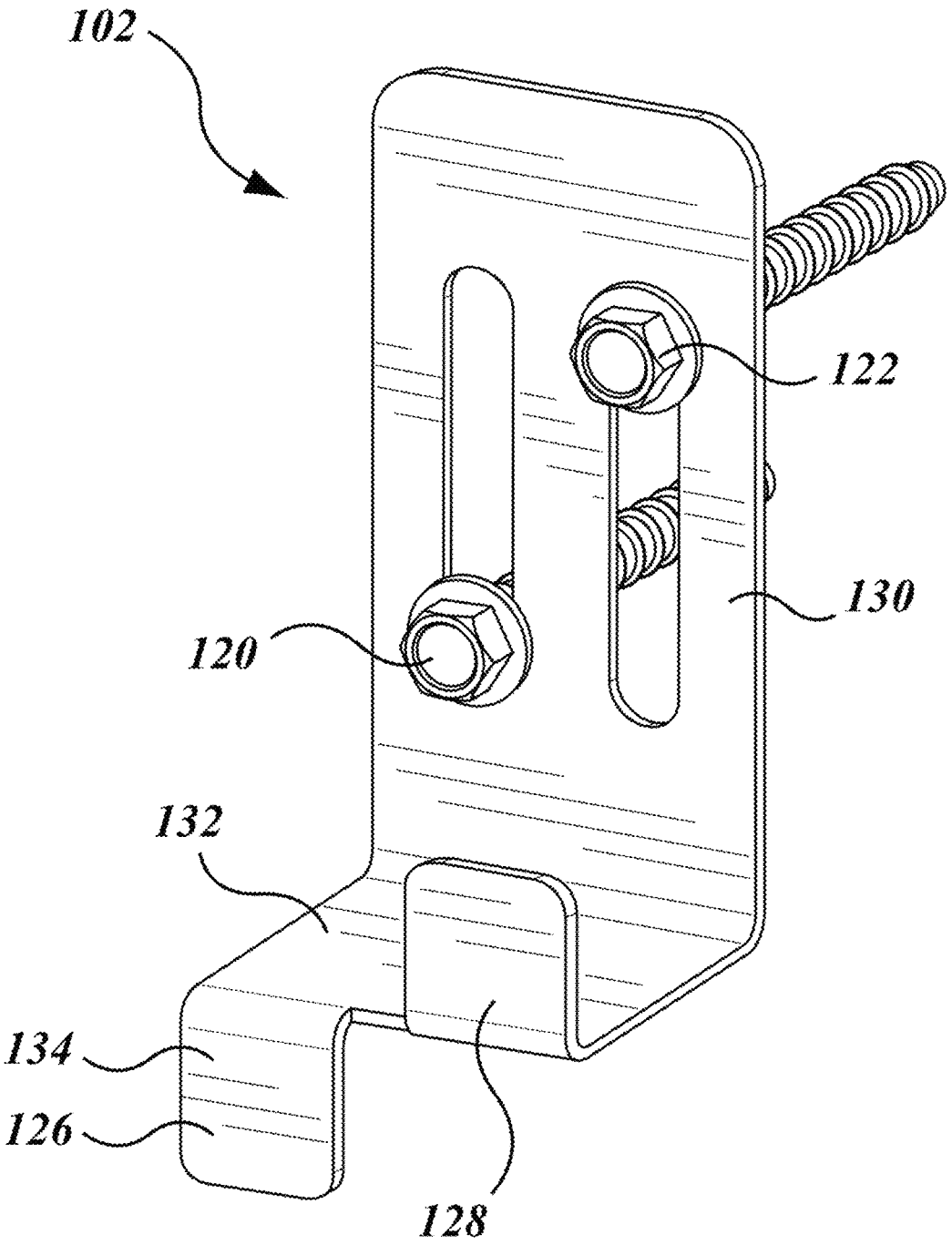
FIG. 5A (Prior Art)
FIG. 5*a* is a front isometric view of a first retainer of the assemblies of FIGS. 3*c*-3*f* with fastening hardware in position.
Figure 5B:
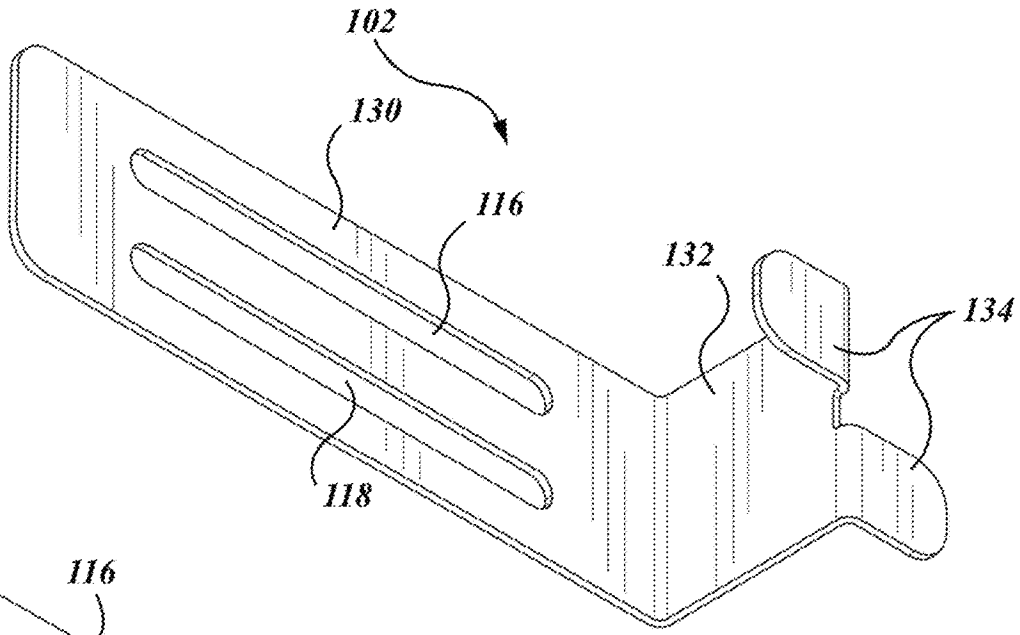
FIG. 5B (Prior Art)
FIG. 5*b* is a rear isometric view of the first retainer of FIG. 5*a;*
Figure 5C:
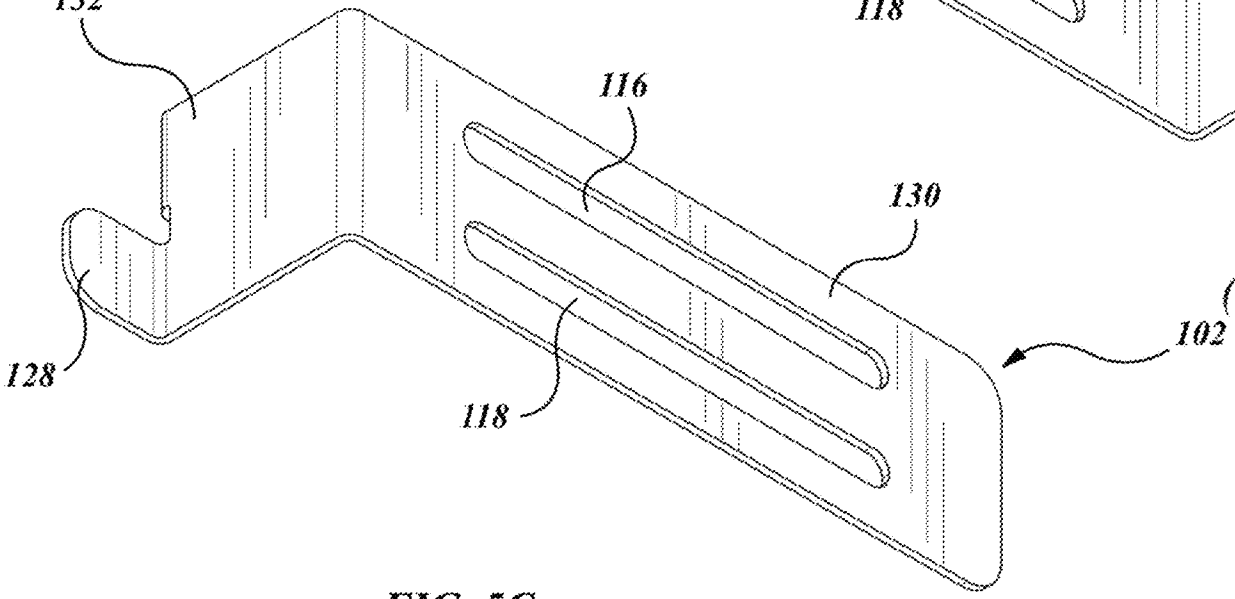
FIG. 5C (Prior Art)
FIG. 5*c* is an opposite isometric view of the first retainer of FIG. 5*b;*
Figure 5D:
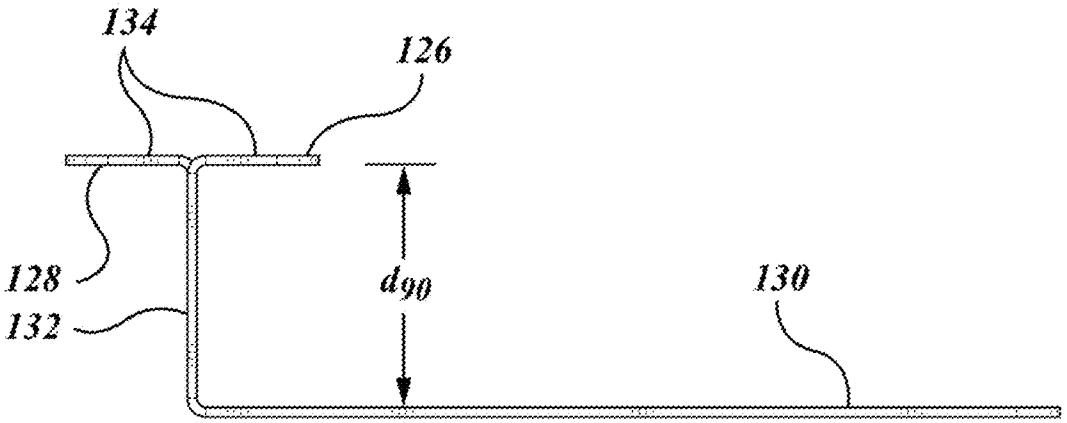
FIG. 5D (Prior Art)
FIG. 5*d* is a side view of the first retainer of FIG. 5*b;*
Figure 5E:
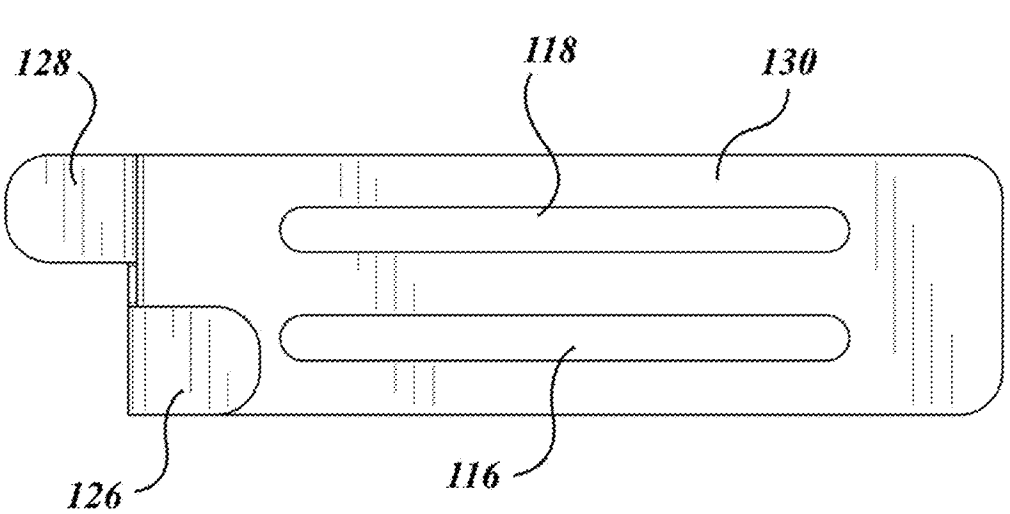
FIG. 5E (Prior Art)
FIG. 5*e* is a front view of the first retainer of FIG. 5*b; and*
Figure 5F:
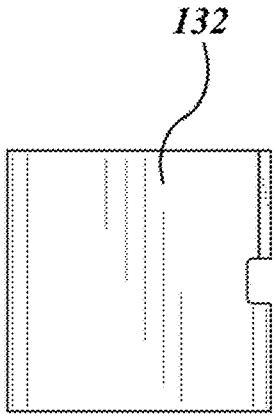
FIG. 5F (Prior Art)
FIG. 5*f* is an end view of the first retainer of FIG. 5*b.*

Bottom edge fitting 100 is shown in FIGS. 4*a*-4*e*. Bottom edge fitting 100 may have the shape of a 'J' when seen in side view. That is, it may have a first leg 110, a back or web 112, and a second leg 114. First leg 110 and second leg 114 may lie in substantially parallel planes. First leg 110 is substantially longer than second leg 114. The length and width of leg 110 are indicated in FIGS. 4D and 4E as $L_{110}$ and $w_{110}$ respectively. First leg 110 has mechanical fastener accommodations 116, 118. Those accommodations 116, 118 may have the form of first and second apertures, or slots. The length and width of those slots are indicated in FIGS. 4E and 5E as $L_{118}$ and $w_{118}$ respectively. In use, mechanical fasteners 120, 122 are driven through those slots into load bearing structure 20, either directly or into fittings formed or mounted in load bearing structure 20 more generally. Mechanical fasteners 120, 122 may be screws or bolts suitable for mating engagement, or attachment to, the underlying support structure 20, be it wood framing; steel beams, columns, or trusses; concrete, or some combination thereof. Mechanical fasteners 120, 122 may tend to be staggered in height. The uppermost, shown as 120 in the Figures, may typically be located at the upper extremity of its slot, such that vertical shear loading in leg 110 is transferred directly into the shank of the fastener, which is itself tightened into the supporting structure so that there is no play in the connection. To that end, the fastening hardware may include a washer or spacer under the head of the fastener.

Second leg 114 may have a central slot 124 that divides leg 114 into two parts, which may be termed toes, or hooks, or fingers 106, 108. When a cladding panel such as panel 30, or 34 is installed, fingers 106, 108 seat in the space, gap, slot, pocket, or accommodation between first panel 36 and second panel 38. Notably, in respect of lower edge fitting 100 and upper edge fitting 104, both fingers 106 and 108 extend in the same direction. As can be seen the space in the reach of the hook, i.e., the clearance space between fingers 106, 108 and first leg 110, corresponds to the through-thickness of the insulation second layer 38, between the rear face of layer 38 and slot 96 (or 98). As above, that reach, or distance, may be identified as $d_{96}$. The insulation deforms to admit the heads of the mechanical fasteners 120, 122. In the case of the bottom edge fitting 100, fasteners 120, 122 may be tightened to prevent movement of fitting 100.

Upper or top edge fitting 104 may be the same as bottom edge fitting 100, but is installed in reverse, i.e., so that instead of fingers 106, 108 facing upward to engage accommodation 90 in the bottom edge 80 of second panel 38, they face downward into the upper slot of accommodation 96 in top edge 46 of panel 38. Mechanical fasteners 120, 122 are then tightened snug, while still permitting vertical sliding motion greater than twice the length of fingers 106, 108. Upper edge fitting 104 is moved to its first or highest, or retracted position, such as to permit e.g., a first cladding panel 30 (or 34 or 36 as may be) to slide in the x-direction in the clearance space between the tips of upward facing fingers 106, 108 of bottom edge fitting 100 and the downward facing fingers 106, 108 of top edge fitting 104. The bottom edge fits into the grip of bottom edge fitting 104 and slides down the length of the fingers. The top edge fitting then slides downward double that distance until the top edge of the insulation layer is captured in the grip of the downwardly extending fingers of top edge fitting 104.

Intermediate edge fitting 102 is substantially the same as bottom edge fitting 100 or top edge fitting 104, but rather than having two fingers that are folded in the same direction, intermediate fitting has a first leg 130, a linking web 132, and a second leg 134, corresponding to items 110, 112 and 114 respectively. The length and width of leg 130 are indicated in FIGS. 5D and 5E as $L_{130}$ and $w_{130}$, respectively. Second leg 134 has fingers 126, 128 that are bent in opposite directions, so that, as installed, one faces upwardly and one faces downwardly. To the extent that, as installed, first leg 130 is mounted to extend upwardly from web 132, first leg 130 may be shorter than first leg 110. That is leg 130 locates in its final position when downward extending finger 126 locates on the lower panel, e.g., panel 30, the position of leg 130 is fixed, and fasteners 120 are driven into slots 136, 138, one at the top and one at the bottom. In this instance no linear slack is required to permit sliding, since leg 130 need not slide. The next upwardly panel then locates in the upwardly facing grip defined by upwardly extending finger 128. To the extent that bottom edge fitting 100 is installed in a non-sliding position, its fixed leg may be of the shorter version of first leg 130.

In the context of this description, each of the wall cladding support fittings 100, 102 and 104 can be termed a "retainer". The term retainer may also be applied to the extended finger alone, as in the sense of fingers 106, 108, 126 and 128 being retainers. The terminology may be used in either sense herein and in the claims appended hereto.

As can then be understood, in the context of multiple rows of panels, the bottom row of cleats is installed along the lower edge of the supporting wall structure in a fixed position. The first panel 30 is seated in the grip of cleats 100. The next row of intermediate cleats 102 is installed in fixed position relative to supporting structure 20, trapping first panel 30 in place and presenting a new upward facing accommodation for the next panel, 32. This procedure is repeated as required until the top row of panels, e.g., panel 34, is to be installed. Before that can occur, the top row of cleats 104 is installed with first leg 110 extending downward, and with the cleat moved to its first position slid upwardly. Panel 34 is put in place and cleats 104 are then slid to their second position, entrapping panel 34. When so positioned, the fingers of the various cleats are seated in the slots between layers 36 and 38, and, from the front the panels 30, 32, 34 etc., are in abutting relationship and the retainers are not seen from the front face of the panels. In the case of the moving cleats, the range of motion of the upper cleat exceeds twice the length of the fingers 106, 108, 126, 128 to permit installation of the cladding panel.

In one embodiment, the masonry veneer layer is made of a steel calcium silicate board, and said thermal insulation layer is made of expanded polyurethane or expanded polystyrene. As can be seen, in the embodiments shown, the wall mounting fittings 100, 102, 104 all include J-shaped fittings having a first leg, a second leg, and a web extending between the first and second legs. The first leg is longer than the second leg. The first leg has slots in which to admit mechanical fasteners. As installed, at least one row of the mounting fittings (which could be a single fastener where the other row has at least two spaced apart retainers to provide static determinacy) is secured to stationary support structure and has a slidable range of motion relative to said support structure.

The embodiments illustrated and described above illustrate individual non-limiting examples in which the principles of the present invention are employed. It is possible to make other embodiments that employ the principles of the invention and that fall within the following claims. To the extent that the features of those examples are not mutually exclusive of each other, the features of the various embodiments may be mixed-and-matched, i.e., combined, in such manner as may be appropriate, without having to resort to repetitive description of those features in respect of each possible combination or permutation. The invention is not limited to the specific examples or details which are given by way of illustration herein, but only by the claims, as mandated by law. The claims are to be given the benefit of purposive interpretation to include equivalents under the doctrine of equivalents.

Although the various embodiments have been illustrated and described herein, the principles of the present invention are not limited to these specific examples which are given by way of illustration, but only by a purposive reading of the claims.

I claim:

1. A wall cladding assembly comprising:

at least a first wall veneer panel, said wall veneer panel having a first layer and a second layer;

said first layer being a masonry veneer layer having a first surface, a second surface and a through-thickness;

said first surface being a finished surface for external viewing;

said second surface being opposed to said first surface and facing rearwardly;

said second surface having a first set of seats formed in said masonry veneer layer;

said first set of seats including grooves formed in said masonry veneer layer;

said second layer having a length and a width corresponding to said first layer;

said second layer including a rigid thermal insulation material;

said second layer being a monolith of said rigid thermal insulation material;

said monolith having a first surface and a second surface;

said first surface of said monolith facing toward said first layer;

said second surface of said monolith facing away from said first layer;

said monolith having a through thickness between said first and second surface thereof;

said monolith having a second set of seats, said second set of seats including an array of protrusions of said monolith, said second set of seats of said monolith being mechanically engaged to said first set of seats of said first layer;

said grooves having a depth;

said protrusions having a length;

said length being greater than said depth;

said protrusions and said grooves being engaged to establish a standoff air gap between said first layer and said second layer; and said second layer having mounting fitting accommodations.

2. The wall cladding assembly of claim 1 wherein said mounting fitting accommodations are defined at least in part by said air gap.

3. The wall cladding assembly of claim 1 wherein said thermal insulation of said second layer has slots formed therein to define said mounting fitting accommodations, said slots being spaced away from said gap.

4. The wall cladding assembly of claim 1 wherein said masonry veneer layer is made of a steel calcium silicate board, and said thermal insulation layer is made of expanded polyurethane or expanded polystyrene.

5. The wall cladding assembly of claim 1 and a set of wall mounting fittings, wherein said wall mounting fittings include J-shaped fittings having a first leg, a second leg, and a web extending between said first and second legs; said first leg being longer than said second leg; said first leg being longer than wide; said second leg, as installed, being seated in a respective one of said mounting fitting accommodations of said second layer of said first leg having slots in which to admit mechanical fasteners; and at least one of said mounting fittings being secured to stationary support structure and having a slidable range of motion relative to said support structure.

* * * * *